US005975153A

United States Patent [19]

Hill et al.

[11] Patent Number: 5,975,153

[45] Date of Patent: Nov. 2, 1999

[54] CAPILLARY FILL TEST DEVICE WITH IMPROVED FLUID DELIVERY

[75] Inventors: James L. Hill; Sherry C. Phillips, both of Carmel; Alexander T. Newhart, Westfield; Ryan Neil Hudson, Greenwood; Nancy W. Sutton; Waring Charles Lynch, both of Indianapolis; Charles L. Thomeczek, Jr., Fishers, all of Ind.

[73] Assignee: Roche Diagnostics Corporation, Indianapolis, Ind.

[21] Appl. No.: 09/023,671

[22] Filed: Feb. 13, 1998

[51] Int. Cl.[6] ..... B65B 1/04

[52] U.S. Cl. ..... 141/31; 73/863.71; 73/864.72

[58] Field of Search ..... 141/31; 73/863.71, 73/863.72, 863.73, 864, 864.72; 422/99, 100

[56] References Cited

U.S. PATENT DOCUMENTS

| | | | |
|---|---|---|---|
| 4,549,952 | 10/1985 | Columbus | 204/416 |
| 4,849,340 | 7/1989 | Oberhardt | 435/13 |
| 5,019,351 | 5/1991 | Schulz | 73/864.72 |
| 5,110,727 | 5/1992 | Oberhardt | 435/13 |
| 5,300,779 | 4/1994 | Hillman et al. | 250/341 |
| 5,522,255 | 6/1996 | Neel et al. | 73/64.43 |
| 5,526,111 | 6/1996 | Collins et al. | 356/39 |
| 5,591,403 | 1/1997 | Gavin et al. | 422/73 |
| 5,686,659 | 11/1997 | Neel et al. | 73/53.01 |

*Primary Examiner*—Steven O. Douglas
*Attorney, Agent, or Firm*—Barnes & Thornburg

[57] ABSTRACT

An improved capillary fill test device is described. The device is formed to have a capillary aperture designed and sized to facilitate the filling of the device with fluid incident to its use. The described improvements are particularly useful in the construction of capillary fill devices having a capillary flow conduit of reduced flow through cross-sectional area extending between a fluid sample receiving portion and a capillary fill test volume.

35 Claims, 2 Drawing Sheets

CAPILLARY FILL TEST DEVICE WITH IMPROVED FLUID DELIVERY

FIELD OF THE INVENTION

This invention relates to an improved test device for use in analyzing one or more characteristics of a fluid sample. More particularly, this invention is directed to a capillary fill test device having an improved fluid delivery configuration to facilitate the filling of said device with a fluid sample which is drawn into the device by capillary action.

BACKGROUND ANS SUMMARY OF THE INVENTION

Capillary fill test devices have been manufactured and used in a wide variety of fluid testing applications in the laboratory, in the clinic, in the field and in the home. Such devices allow a rapid, convenient, and dependable analysis using very small sample volumes of test fluids. Capillary fill devices have found wide use particularly in the analysis of blood and other biological fluids.

Generally capillary fill test devices are constructed to have a test fluid receiving structure including a fluid loading port or sample well, a vented fluid test volume for containing the portion of the test fluid from which data characterizing a chemical or physical property of the fluid is collected, and a capillary flow-through conduit for transporting the fluid sample from the fluid receiving structure to the test volume. The capillary conduit includes a capillary aperture communicating with the fluid receiving structure so that when a fluid is delivered to that structure in contact with the capillary aperture, it is drawn through the conduit and into the vented test volume by capillary action. The capillary conduit and the test volume elements of the capillary fill test device are sized to provide consistent analyses and dependable accuracy with a minimum volume of test fluid. In some devices the conduit and the test volume each have the same flow through cross-sectional area and thus appear as a unitary capillary volume. In other devices the conduit portion is visibly distinguishable from the test volume appearing in plan view as a narrowed passageway in the device having a flow through cross-sectional area less than that of the test volume. The test volume typically includes additional components that interact with the fluid (or components of the fluid) delivered to the test volume to provide a photometrically, electrometrically, acoustically or mechanically detectable indication of a physical or chemical property of the fluid.

Capillary fill test devices are generally used in combination with a second device, most typically an electronic instrument designed to detect the existence or the extent of a predetermined interaction of the fluid sample, or one or more analytes in the fluid sample, with one or more other components of the capillary fill device in the test volume, for example, an electrode structure and/or one or more fluid-interactive or analyte-reactive compositions. The electronic instrument is used to assess the sample fluid in the test volume of the device, most typically by photometric or electrometric techniques after a predetermined sample reaction period.

Capillary fill devices are often designed to be positioned in the electronic instrument before the device is loaded with the fluid sample. When the capillary fill device is properly positioned in the instrument, the fluid receiving portion is external to the instrument and accessible to the user, and the test volume is located in electrical or phototransmissive/photoreflective communication with a sensor element capable of detecting and reporting a condition or change of condition of the fluid in the test volume after or during a predetermined time period. A volume of test fluid is then delivered to the fluid receiving structure to contact the capillary aperture of the capillary flow conduit so that it is drawn by capillary action into and through the conduit and into the vented test volume. The instrument can be equipped with sensors to detect the flow of the test fluid through the capillary flow conduit and into the test volume; optionally the instrument can be designed to use such detected flow to initiate a test sequence. In some fluid testing applications, for example, in certain instruments designed for use with capillary fill devices for determining coagulation characteristics of blood, the rate of flow of the liquid through the capillary flow conduit is sensed and used as a parameter in the test sequence. In such testing applications the capillary flow conduit not only serves to deliver the fluid to the vented test volume, but it serves as well to provide means for measuring flow characteristics, i.e., viscosity, of the test fluid as it is delivered to the test volume.

Capillary fill test devices clearly offer the advantage of enabling consistent programmed analysis of small uniform sample volumes. However, the inherently small dimensions of such capillary fill devices also complicate their use, particularly for users having impaired vision or dexterity. Proper filling of a capillary fill device requires that an adequate volume of the test fluid be delivered to the fluid receiving portion and be in contact with the capillary aperture of the capillary flow conduit. The design of some commercially available capillary fill devices is such that an adequate volume of test liquid can be delivered to the fluid receiving portion without contacting the capillary aperture and thus without proper filling of the device.

The present invention addresses that problem and facilitates filling of capillary fill test devices. It provides an improved device having test fluid receiving portion communicating with a capillary flow conduit having a capillary aperture which is much enlarged relative to the flow through cross-sectional area of the capillary flow conduit and the flow through cross-sectional area of the fluid test volume. The enlarged capillary aperture facilitates the filling and use of the device essentially by providing a larger, user friendly, target area for delivery of test fluid for filling the device. When the test fluid is blood, the sample is typically delivered to the device by the user as a finger stick sample, a blood droplet that is formed on the finger after a pin stick. There is obvious advantage to ensuring proper loading or filling of the device on the first try.

Thus, in accordance with one embodiment of the invention there is provided a capillary test device having a fluid sample receiving portion, a vented capillary fill test volume having a first flow through cross-sectional area, and a capillary flow conduit extending between the test volume and the sample receiving portion, and having a capillary aperture for contacting a fluid sample delivered to the sample receiving portion. The capillary flow conduit has a predetermined width in plan view and a flow through cross-sectional area that is less than the cross-sectional area of the capillary aperture and less than the maximum flow through the cross-sectional area of the test volume. In one embodiment the device is constructed using plate elements to form opposite walls of the capillary fill test volume and the capillary flow conduit. The plate elements can be spaced apart using a spacer formed to define the fluid receiving portion, the conduit and the test volume, or one of the plate elements can be formed to include capillary channels in its surface which channels cooperate with the second plate element to define the device capillary fill components. The sample receiving portion can be formed as a port in one plate element. The port is sized to have a dimension greater than or equal to the width of the capillary flow conduit. In one embodiment the capillary flow conduit includes an annular capillary portion having an inner edge coincident with the perimeter of the port so that the capillary aperture of the capillary flow conduit has a cross-sectional area equal to the product of the perimeter of the port and the distance between the opposite walls.

In another embodiment of the present invention the capillary fill device is constructed using spaced apart plate elements to form opposite walls of the capillary fill test volume and the capillary flow conduit. The plate elements have first and second opposite ends and first and second opposite lateral edges. The fluid sample receiving portion and the capillary aperture are defined by at least a portion of the edges of the spaced apart plate elements. The edges of the plate elements defining the capillary aperture can be shaped to provide a visibly discernible indication of the location of the sample receiving portion and the capillary aperture.

In still another embodiment of the present invention there is provided a capillary fill test device having a fluid sample receiving portion, a vented capillary fill test volume having a first flow through cross-sectional area, and a capillary flow conduit having a second flow through cross-sectional area less than said first flow through cross-sectional area. The conduit extends between the test volume and the sample receiving portion and has a capillary aperture for contacting a fluid sample delivered to the sample receiving portion. The capillary aperture is sized to have a cross-sectional area greater than the maximum flow through cross-sectional area of the capillary fill test volume. In that embodiment the sample receiving portion can include a fluid delivery port, and the capillary conduit can include an annular capillary portion communicating with the port. The port is preferably sized to have a dimension greater than the width of the capillary conduit.

DETAILED DESCRIPTION OF THE INVENTION

Figure 1:
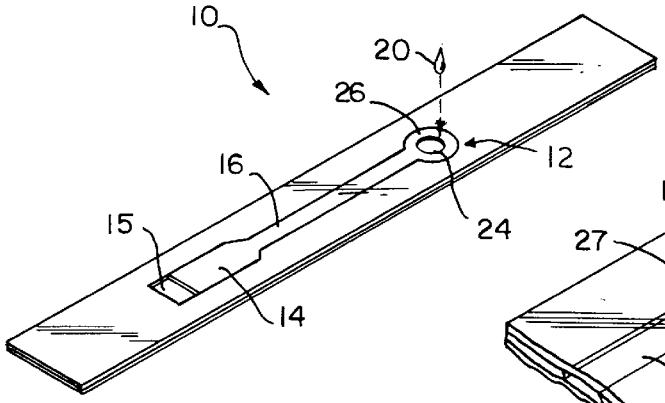
FIG. 1 is a perspective view of a test device in accordance with the invention.

The present invention is directed to an improvement in capillary fill test devices, particularly with respect to the design and structure of the portion of the device used for filling it with a sample test fluid. The improvement finds application to a wide variety of art-recognized capillary fill test devices. The patent and non-patent literature is replete with reference to such devices, their construction, their "chemistry", and their use for determining one or more chemical or physical characteristics of a test fluid. Examples of U.S. Patents describing the construction and use of capillary fill test devices subject to improvement in accordance with the present invention are as follows: U.S. Pat. No. 5,141,868, issued Aug. 25, 1992; U.S. Pat. No. 5,522,255, issued Jun. 4, 1996; U.S. Pat. No. 5, 526,111, issued Jun. 11, 1996; U.S. Pat. No. 5,686,659, issued Nov. 11, 1997; U.S. Pat. No. 5,110,727, issued May 5, 1992; U.S. Pat. No. 5,300,779, issued Apr. 5, 1994; and U.S. Pat. No. 4,849,340, issued Jul. 18, 1989. The disclosures of each of those respective patents is incorporated herein by reference for their teaching of the methods of construction and use of such devices and the diagnostic techniques that can be utilized for determining physical and/or chemical properties of a test fluid in capillary fill devices. Devices utilizing the improvements of the present invention can be constructed utilizing the same procedures and analytical techniques and instrumentation described in those above-mentioned patent references and other available patent and non-patent references relating to capillary fill devices.

With reference to FIGS. 1–6, there is provided in accordance with the present invention a capillary fill diagnostic device 10 having a fluid sample receiving portion 12, a capillary fill test volume 14 having a vent 15 and a capillary flow conduit 16 extending between the test volume 14 and the sample receiving portion 12. In the illustrated embodiment the device 10 is constructed using plate elements 22, 22' to form opposite walls of the capillary fill test volume 14 and the capillary flow conduit 16. The plate elements 22, 22' are spaced apart a distance (d) using spacer element 21 formed to define the sample receiving portion 12, the capillary fill test volume 14, and the capillary flow conduit 16. The spacer element 21 is sandwiched between the plate elements 22, 22', and those components are typically assembled using an adhesive to bond them as a unit. The plate elements are typically plastic or glass, and it is preferred that at least one of the plate elements is transparent. Device components unique to the particular fluid analysis and analytical methods are typically applied to the area on plate 22' corresponding to test volume 14 before or during device assembly.

The vent 15 for capillary fill test volume 14 is formed as a port in plate element 22. Similarly, sample fluid delivery port 24 is formed as a port in plate element 22. The capillary fill test volume 14 has a flow through cross-sectional area defined by its width in plan view and the height of the capillary space equivalent to the distance between the opposing surfaces of plate elements 22 and 22'. Thus the flow through cross-sectional area of the capillary fill test volume 14 is that cross-sectional area of test volume 14 measured generally perpendicular to the flow of fluid into the test volume as the device is filled. Similarly the capillary flow conduit 16 has a flow through cross-sectional area (again, measured generally perpendicular to the flow path between the fluid sample receiving portion 12 and the capillary fill test volume 14). The flow through cross-sectional area of the capillary flow conduit 16 is defined by the width of the conduit in plan view times the distance (d) between the opposing surfaces of plate elements 22 and 22'. Typically the flow through cross-sectional area of the capillary flow conduit is less than or equal to the flow through cross-sectional of test volume 14.

Figure 2:
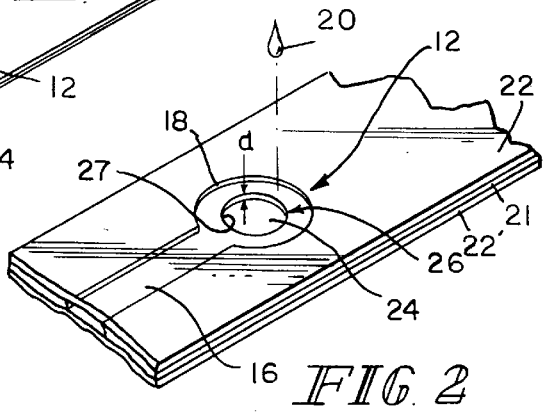
FIG. 2 is similar to FIG. 1 enlarged with portions broken away.
Figure 3:
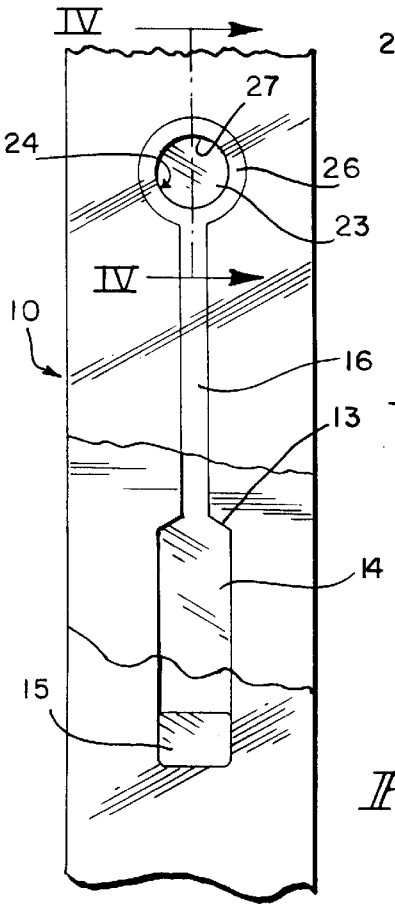
FIG. 3 is a partial plan view of the device shown in FIG. 1.
Figure 4:
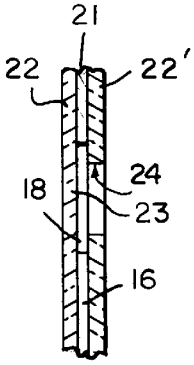
FIG. 4 is a partial cross-sectional view of FIG. 3 through lines IV.
Figure 5:
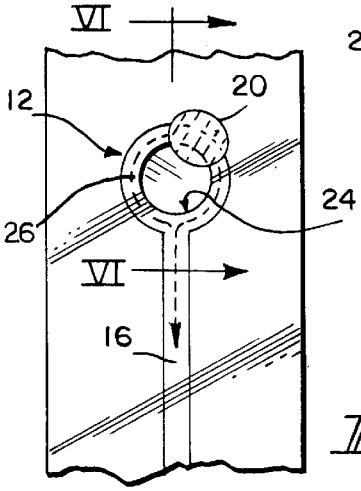
FIG. 5 is similar to FIG. 3 illustrating delivery of a volume of test fluid to the sample receiving portion.
Figure 6:
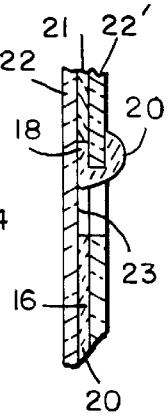
FIG. 6 is a partial cross-sectional view of FIG. 5 at lines VI.
Figure 7:
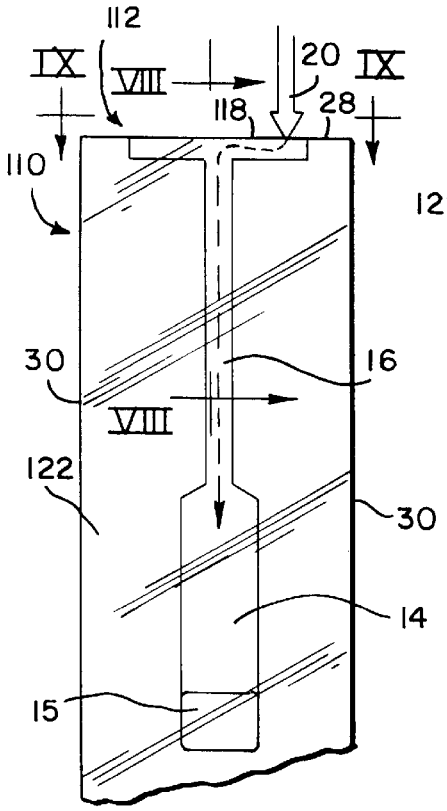
FIG. 7 illustrates another embodiment of the invention wherein the fluid receiving portion and the enlarged capillary aperture is located at an end of the device.
Figure 8:
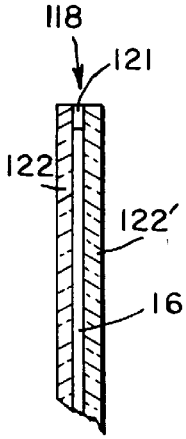
FIG. 8 is a partial cross-sectional view of FIG. 7 at lines VIII.
Figure 9:
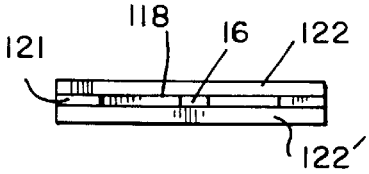
FIG. 9 is an end view of the device of FIG. 7.

As best shown in FIG. 2 the capillary flow conduit 16 includes an annular capillary portion 26 having an inner edge 27 coincident with the perimeter of port 26 in plate element 22 so that the capillary aperture 18 of the capillary flow conduit 16 has a cross-sectional area equal to the product of the perimeter of port 24 and the distance between the opposing walls of the capillary flow conduit 16.

As best shown by FIGS. 3–6, a fluid sample 20 delivered to fluid sample receiving portion 12 through port 24 to contact opposite wall 23 and capillary aperture 18 is drawn into capillary fill test volume 14 through capillary flow conduit 16 and annular capillary port 24. Because capillary aperture 18 is co-extensive with the perimeter of port 24, sample fluid 20 can be efficiently delivered to capillary fill test volume 14 by delivering it through port 24 such that it contacts the edge of that port at any point on its circumference.

Thus in accordance with this invention the capillary aperture 18 is greater than the flow through cross-sectional area of both the capillary fill test volume 14 and the capillary flow conduit 16. In preferred embodiments the cross-sectional area of the capillary aperture 18 is greater than 3.2 times, more preferably at least four times greater than the flow through cross-sectional area of capillary flow conduit 16. Port 24 is sized to have a diameter at least as great, preferably greater than the width of capillary flow conduit 16. Preferably the diameter of the port 24 is at least two times the width of capillary flow conduit 16. Notably, too, with reference particularly to FIGS. 1 and 3, capillary fill test volume 14 includes a tapered portion 13 communicating with capillary flow conduit 16, and thus includes portions have a flow through cross-sectional area intermediate between the flow through cross-sectional area of capillary flow conduit 16 and the maximum cross-sectional flow through area of capillary fill test volume 14 defined by the width of test volume 14 at its point of maximum width and the distance between the opposing surfaces of plate elements 22 and 22' defining opposite walls of the test volume 14 and capillary flow conduit 16. Thus where the flow through cross-sectional area of the capillary fill test volume is used in defining the present invention, it shall be understood that such terminology refers to the cross-sectional flow through area of the test volume at its widest point.

FIGS. 7–12 illustrate additional capillary fill test devices 110 in accordance with this invention. Each of the illustrated device embodiments includes a fluid sample receiving portion 112, a capillary fill test volume 14 and a capillary flow conduit 16 extending between the test volume 14 and the fluid sample receiving portion 112. Generally the capillary flow conduit 16 has a flow through cross-sectional area less than the flow through cross-sectional area of capillary fill test volume 14. This allows for transport of a test fluid sample 20 delivered to the fluid sample receiving portion 112 to capillary fill test volume 14 with minimal fluid sample volumes. Similar to the construction of the devices illustrated in FIGS. 1–6, capillary fill test device 110 is constructed using plate elements 122, 122' to form opposite walls of the capillary fill test volume 14 in the capillary flow conduit 16. The plate elements 122, 122' are spaced apart using spacer element 121 formed to define the sample receiving portion 112, the capillary fill test volume 14 and the capillary flow conduit 16. Vent 15 for the capillary fill test volume 14 is formed as a port in plate element 122.

Figure 11:
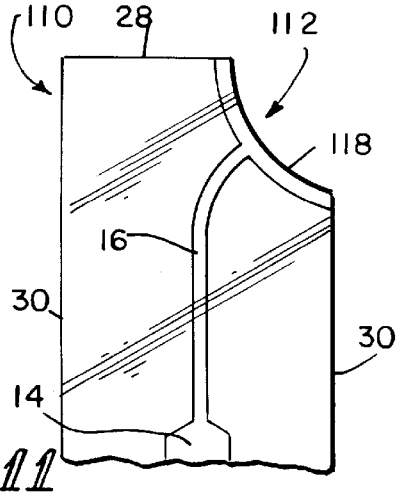
FIGS. 10–12 are similar and illustrate embodiments of the invention wherein the fluid receiving portion of the device is located on an end or edge of the device and wherein the end/edge is contoured to provide a visibly discernible indication of the location of the fluid receiving portion and the capillary aperture.
Figure 10:
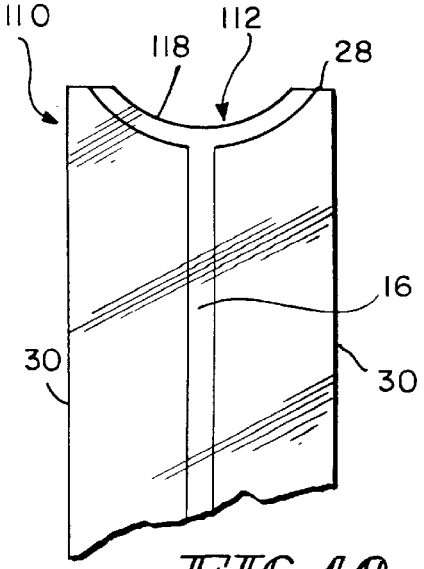
Figure 12:
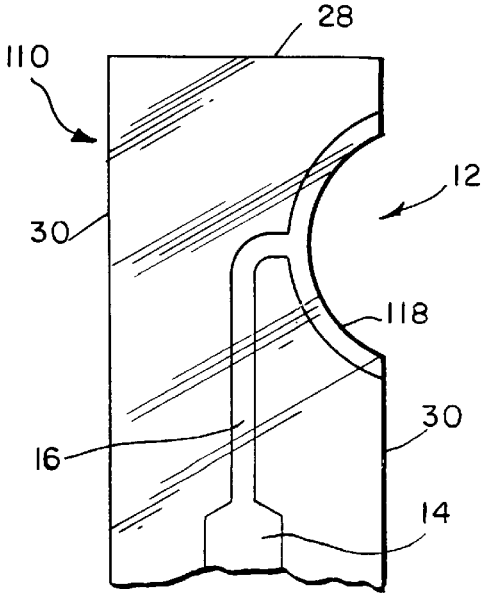

Plate elements 122 and 122' include opposite ends 28 and opposite lateral edges 30. The fluid sample receiving portion 112 and the capillary aperture 118 are defined by at least a portion of one of the edges 28, 30 of plate elements 122 and 122'. The capillary aperture 118 is defined by a portion of the opposing edges of plate elements 122 and 122'. It is sized to have a cross-sectional area greater than the flow through cross-sectional area of capillary flow conduit 16. In preferred embodiments the capillary aperture 118 has a cross-sectional area greater than the maximum flow through cross-sectional area of test volume 14 and at least two times the flow through cross-sectional area of the capillary flow conduit 16. With reference to FIGS. 10–12, the edges of the plate elements 122 and 122' defining fluid sample receiving portion 112 and capillary aperture 118 are shaped to provide a visibly discernible indication of the location of the sample receiving portion 112 and capillary aperture 118. In the illustrated embodiments capillary aperture 118 has a length coincident with the shaped edge portion of plate elements 122 and 122'. Thus a fluid sample can be delivered at any point on the radius of the shaped fluid receiving portion and be drawn by capillary action into the capillary aperture through capillary flow conduit 16 and into capillary fill test volume 14.

The capillary flow test volume 14 typically includes one or more additional elements selected to interact with the test fluid drawn into the test volume to provide a detectable signal characteristic of a physical or chemical condition of the test fluid. Such elements will, of course, vary dependent on the nature of the fluid sample, the nature of the interaction or condition to be detected, and the method of detecting such interaction. Thus the capillary fill test volume can include predetermined amounts of fluid-interactive compositions or compounds, or electrodes when amperometric or voltametric detection techniques are utilized. Plate elements 22, 22', 122, 122' are typically formed from glass or plastic sheets or films, or a combination thereof. When phototransmissive/photoreflective techniques are utilized to detect a condition of the fluid sample in the capillary fill test volume 14, at least one of the plate elements is formed from a transparent glass or plastic sheet or film.

The embodiments of the invention depicted in the accompanying drawings are intended to be non-limiting illustrative embodiments. It will be recognized by skilled practitioners that there are other embodiments within the scope of the following claims that can be designed to take advantage of the disclosed invention, and it is intended that such other embodiments be within the scope of the following claims.

We claim:

1. A capillary fill test device comprising a fluid sample receiving portion, first and second plate elements defining a capillary space including a vented capillary fill test volume having a first flow through cross-sectional area and a capillary flow conduit having a second flow through cross-sectional area less than said first flow through cross-sectional area, said conduit extending in capillary flow communication between the test volume and the sample receiving portion and said conduit having a capillary aperture communicating with said sample receiving portion, said capillary aperture having a cross-sectional area greater than the first flow through cross-sectional area and positioned to contact a fluid sample delivered to the sample receiving portion so that at least a portion of the sample is transferred by capillary action into the capillary flow conduit and into the vented capillary fill test volume.

2. The capillary fill device of claim 1 in wherein the cross-sectional area of the capillary aperture of the capillary flow conduit is at least four times greater than the second flow through cross-sectional area.

3. The capillary fill device of claim 1 wherein the fluid sample receiving portion includes a port in one of the plate elements and wherein the capillary flow conduit includes an annular capillary portion having an inner edge coincident with the port in the plate element.

4. The device of claim 1 wherein the plate elements form opposite walls of the capillary fill test volume and the capillary flow conduit, and the sample receiving portion is formed as a port in one plate element and the capillary flow conduit includes an annular capillary portion having an inner edge portion coincident with the perimeter of the port so that the capillary aperture of the capillary flow conduit has a cross-sectional area equal to the product of the perimeter of the port and the distance between the opposite walls.

5. The device of claim 1 wherein the plate elements spaced apart form opposite walls of the capillary fill test volume and the capillary flow conduit and said plate elements having first and second opposite end edges and first and second opposite lateral edges, and the fluid sample receiving portion and the capillary aperture are defined by at least a portion of the edges of the spaced apart plate elements.

6. The device of claim 5 wherein the fluid sample receiving portion and the capillary aperture are located at a lateral edge plate of the plate elements.

7. The device of claim 6 wherein the fluid sample receiving portion and the capillary aperture are defined by a shaped edge portion of the plate elements bridging a lateral edge and an end of the plate elements.

8. The device of claim 5 wherein the fluid sample receiving portion and the capillary aperture are located at an end edge of the plate elements.

9. The device of claim 5 wherein the edges of the plate elements defining the capillary aperture are shaped to provide a visibly discernable indication of the location of the sample receiving portion and the capillary aperture.

10. The device of claim 9 wherein the fluid sample receiving portion and the capillary aperture are located at a lateral edge of the plate elements.

11. The device of claim 9 wherein the fluid sample receiving portion and the capillary aperture are located at an end edge of the plate elements.

12. The device of claim 1 wherein the cross-sectional area of the capillary aperture is at least two times the flow through cross-sectional area of the capillary flow conduit.

13. The device of claim 1 wherein the cross-sectional area of the capillary aperture is greater than three times the flow through cross-sectional area of the capillary flow conduit.

14. In a capillary fill test device having a fluid sample receiving portion, spaced apart plate elements defining a vented capillary test fill test volume having a maximum first flow through cross-sectional area and a capillary flow conduit extending between said test volume and the sample receiving portion and having a flow through cross-sectional area less than the first flow through cross-sectional area, and said conduit having a capillary aperture communicating with the fluid sample receiving portion for contacting a fluid sample delivered to the receiving portion, the improvement wherein the capillary aperture of the capillary flow conduit has a cross-sectional area greater than the maximum flow through cross-sectional area of the capillary fill test volume.

15. The improvement of claim 14 wherein the fluid sample receiving portion comprises a port in one of the plate elements and the capillary flow conduit includes an annular capillary portion having an inner edge coincident with the the perimeter of the port.

16. The improvement of claim 14 wherein the plate elements form opposite walls of the capillary fill test volume and the capillary flow conduit, and the fluid sample receiving portion is formed as a fluid sample delivery port in one plate element.

17. The improvement of claim 16 wherein the cross-sectional area of the capillary aperture is at least four times greater than the flow through cross-sectional flow through area of the capillary conduit.

18. The improvement of claim 14 wherein the plate elements form opposite walls of the capillary fill fluid test volume and the capillary flow conduit, and the fluid sample receiving portion is formed as a delivery port in one plate element, and the capillary flow conduit includes an annular capillary portion having an inner edge coincident with the perimeter of the port so that the capillary aperture is defined by the perimeter of the delivery port and the opposite wall of the device whereby the cross-sectional area of the capillary aperture is equal to the product of the perimeter of the delivery port and the distance between the opposite walls.

19. The improvement of claim 14 wherein the plate elements form opposite walls of the capillary fill fluid test volume and the capillary flow conduit, said plate elements having first and second opposite end edges and first and second opposite lateral edges, and the fluid sample receiving portion and the capillary aperture are defined by at least a portion of the edges of the plate elements.

20. The improvement of claim 19 wherein the edges of the plate elements defining the sample receiving portion and the capillary aperture are shaped to provide a visibly discernible indication of the location of the sample receiving portion and the capillary aperture.

21. The improvement of claim 20 wherein the edges of the plate elements defining the sample receiving portion and the capillary aperture are shaped to provide a visibly discernible indication of the location of the sample receiving portion and the capillary aperture.

22. A capillary fill test device comprising a fluid sample receiving portion, a vented capillary fill test volume having a first flow through cross-sectional area, and a capillary flow conduit extending between the test volume and the sample receiving portion and a capillary aperture for contacting a fluid sample delivered to the sample receiving portion, said conduit having a width and a second flow through cross-section area, said test device being constructed using plate elements to form opposite walls of the capillary fill test volume and the capillary flow conduit, and the sample receiving portion is formed as a port in one plate element, the port being sized to have a dimension greater than the width of the capillary flow conduit, said capillary aperture having a cross-sectional area greater than the flow through cross-sectional area of the capillary flow conduit.

23. The device of claim 22 wherein the second flow through cross-sectional area is less than the first flow through cross-sectional area.

24. The device of claim 22 wherein the second flow through cross-sectional area is equal to the first flow through cross-section area.

25. The device of claim 22 wherein the capillary flow conduit includes an annular capillary portion having an inner edge coincident with the perimeter of the port so that the capillary aperture of the capillary flow conduit has a cross-sectional area equal to the product of the perimeter of the port and the distance between the opposite walls.

26. The device of claim 22 where the port is circular and the diameter of the port is greater than the width of the capillary flow conduit.

27. The device of claim 22 wherein the plate elements are spaced apart using a spacer formed to define the fluid sample receiving portion, the test volume and the capillary flow conduit.

28. A capillary fill test device having a fluid sample receiving portion, a vented capillary fill test volume having a first flow through cross-sectional area, and a capillary flow conduit extending between the test volume and the sample receiving portion and having a capillary aperture for contacting a fluid sample delivered to the sample receiving portion, said conduit having a width and a second flow through cross-section area, said test device being constructed using plate elements to form opposite walls of the capillary fill test volume and the capillary flow conduit, said plate elements having first and second opposite ends and first and second opposite lateral edges, and the fluid sample receiving portion and the capillary aperture are defined by at least a portion of the edges of the plate elements wherein the capillary aperture has a cross-sectional area greater than the flow through cross-sectional area of the capillary flow conduit.

29. The device of claim 28 wherein the capillary aperture has a cross-sectional area at least two times the flow through cross-sectional area of the capillary flow conduit.

30. The device of claim 28 wherein the edges of the plate elements defining the sample receiving portion and the capillary aperture are shaped to provide a visibly discernible indication of the location of the sample receiving portion and the capillary aperture.

31. A capillary fill test device comprising a fluid sample receiving portion, a vented capillary fill test volume having a first flow through cross-sectional area, and a capillary flow conduit extending between the test volume and the sample receiving portion and a capillary aperture for contacting a fluid sample delivered to the sample receiving portion, said conduit having a width and a second flow through cross-sectional area, the sample receiving portion of said device being formed as a port sized to have a dimension greater than the width of the capillary flow conduit.

32. The device of claim 31 wherein the capillary aperture has a cross-sectional greater than the flow through cross-sectional area of the capillary flow conduit.

33. The device of claim 31 wherein the second flow through cross-sectional is less than the first flow through cross-sectional area.

34. The device of claim 31 wherein the second flow through cross-sectional area is equal to the first flow through cross-sectional area.

35. The device of claim 31 wherein the capillary flow conduit includes an annular capillary portion having an inner edge coincident with the perimeter of the port.

* * * * *